United States Patent [19]

Benesh

[11] Patent Number: 4,535,558

[45] Date of Patent: Aug. 20, 1985

[54] CARTRIDGE HOLDER

[76] Inventor: Vladimir Benesh, 14036 95th Ave., NE., Bothell, Wash. 98011

[21] Appl. No.: 590,156

[22] Filed: Mar. 16, 1984

[51] Int. Cl.[3] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 881,437 | 3/1908 | Neal | 42/89 |
| 913,393 | 2/1909 | Kellogg | 42/89 |
| 923,068 | 5/1909 | Neal | 42/89 |
| 1,202,343 | 10/1916 | Wesson et al. | 42/89 |
| 1,231,106 | 6/1917 | Wesson | 42/89 |
| 2,215,726 | 9/1940 | Masterton-Smith | 42/89 |

FOREIGN PATENT DOCUMENTS

| | | | |
|---|---|---|---|
| 3107729 | 8/1982 | Fed. Rep. of Germany | 42/89 |

*Primary Examiner*—Charles T. Jordan

*Attorney, Agent, or Firm*—Christensen, O'Connor, Johnson & Kindness

[57] ABSTRACT

A device for securing a number of cartridges in proper position for rapid insertion into a firearm cylinder. A substantially annular flat member is formed with several semicircular resilient bands. Each band flexes to accommodate a cartridge that is forced into the recess formed by the bands. The bands wrap around a portion of the cartridge's circumference securely holding it in place. Gaps between each recess allow the holder to alter its overall circumferential shape to adapt to minor variations in manufactured firearm cylinders.

5 Claims, 5 Drawing Figures

CARTRIDGE HOLDER

BACKGROUND OF THE INVENTION

This invention relates to cartridge holders or clips used for securing a number of cartridges in position for simultaneous loading into the cylinder of a revolver.

The cylinder of a typical revolver is essentially comprised of six or more adjacent chambers into which cartridges are placed for firing. During operation of the revolver, the cylinder is rotated so that an unfired cartridge is aligned with the barrel of the revolver and is positioned so that the firing mechanism can strike the cartridge, thereby causing ignition of the powder to form gas that propels the bullet portion of the cartridge through the barrel.

Earlier versions of cartridge holders feature substantially annular devices having a series of openings or recesses around the circumference of the device. These recesses are shaped from prong-like members that extend from the interior portion of the annular device. These prongs are normally formed of resilient material and grasp the end portion of a standard cartridge after the cartridge is forced through the opening of the prongs. Previously developed cartridge holders are so designed that a cartridge shell, once past the narrow opening of the prongs, will be loosely seated in a recess that is designed to be slightly larger than the diameter of the cartridge. This loose fit creates difficulties when attempting to place a fully loaded cartridge holder into the firearm cylinder since each individual cartridge must be properly aligned with its corresponding cylinder chamber prior to insertion.

It is the object of this invention to provide a cartridge holder that securely holds each individual cartridge in proper alignment for insertion into a revolver chamber. It is another object of this invention to provide a cartridge holder that, when loaded into a revolver chamber, will adapt to distorting forces resulting from dissimilarities existing in the alignment of chambers of mass produced revolver cylinders.

SUMMARY OF THE INVENTION

In accordance with the foregoing objects and other objects that will become apparent to one of ordinary skill upon reading the following specification, the present invention provides a cartridge holder that is a substantially flat member of roughly annular shape having a plurality of separate radially oriented outward extensions that are formed from the end portions of substantially semicircular-shaped, resilient bands. The bands open outward and are so shaped that when the end portion of a standard cartridge is pressed between any two outward extensions, the resilient band encompasses and conforms to a substantial portion of the cartridge circumference securing the cartridge to the flat annular member. When fully loaded, a ring or circle of cartridges is formed. The cartridge holder is designed so that there are gaps between adjacent cartridges. These gaps allow the diameter and overall shape of the cartridge circle to change in response to different shapes of firearm cylinders that arise from inconsistencies in the cylinder manufacturing process. The present invention thus provides a cartridge holder for rapid, easy simultaneous loading of cartridges into various revolver cylinders that differ slightly in shape from one manufactured cylinder to another.

BRIEF DESCRIPTION OF THE DRAWINGS

A better understanding of the invention can be derived by reading the ensuing specification in conjunction with the accompanying drawings wherein.

DETAILED DESCRIPTION OF THE INVENTION

Figure 1:
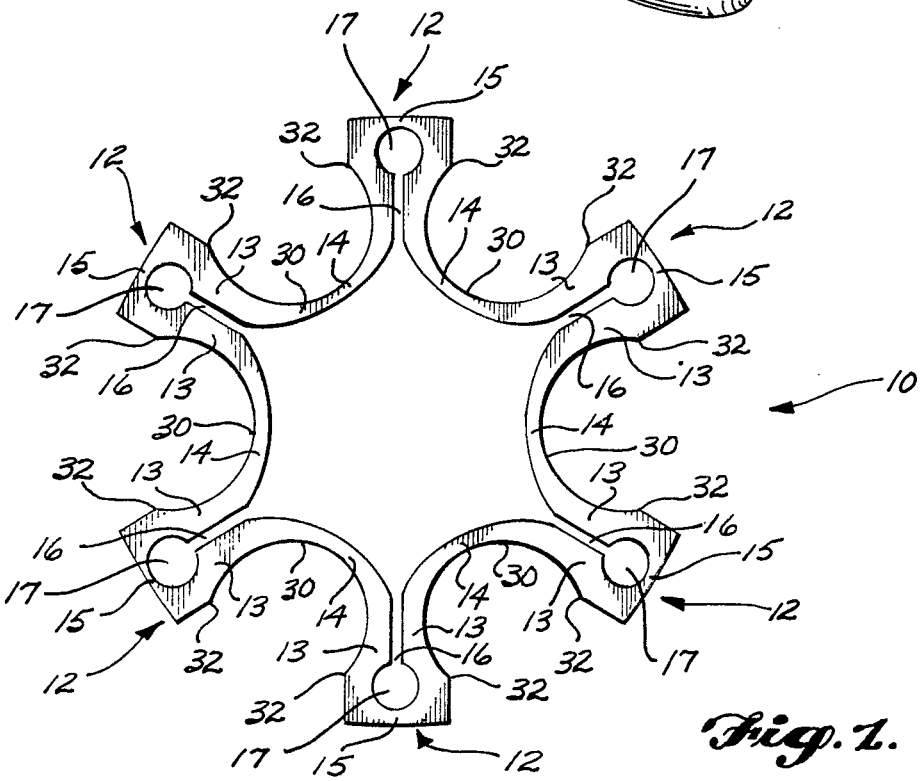
FIG. 1 is a plan view of the cartridge holder constructed in accordance with the invention.

Referring first to FIG. 1, the preferred embodiment of the cartridge holder of the present invention 10 is preferably formed from spring steel having separate radial extensions 12 that are formed from the end portions 13 of substantially semicircular resilient bands 14. Each pair of end portions 13 that make up the extensions 12 are maintained in relatively parallel spaced juxtaposition. The interior edges of each pair of end portions 13 are defined by straight, substantially radial lines that terminate in inward facing semicircles. The outermost point of the semicircles form a connecting line between a pair of end portions 13. The configuration provides an elongated radially oriented gap 16 between each pair of end portions 13 that opens to form a substantially circular void 17 at the outward terminus of the gap 16. The circular shape of void 17 is defined and substantially enclosed by the pair of end portions 13 and a thin circumferential bar 15 that forms the outermost portion of each extension 12. The exterior boundary of circumferential bar 15 extends across the width of extension 12 in a line essentially orthogonal to the radial centerline of the extension. As will be discussed more thoroughly below, gap 16 accounts for the cartridge holder's capability to respond to shape differences in various manufactured revolver cylinders. These shape differences are a result of the manufacturing tolerance variations.

Figure 2:
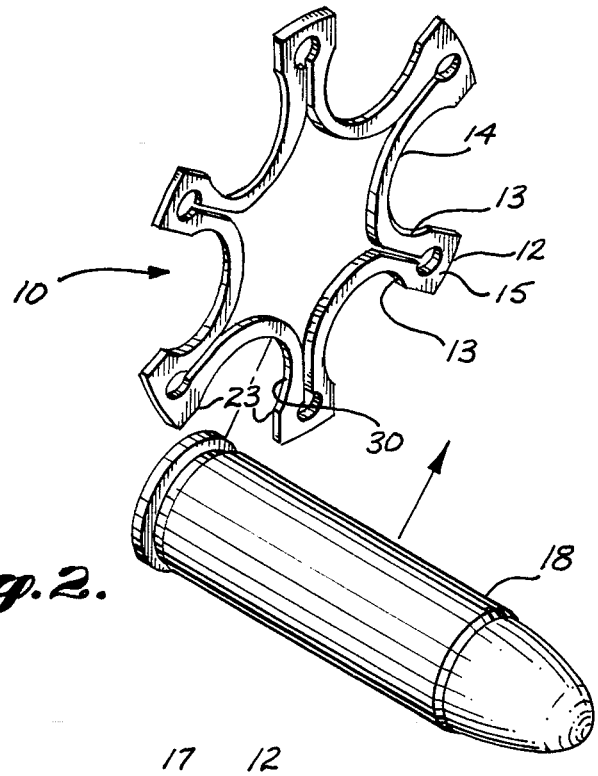
FIG. 2 is an isometric view of the cartridge holder showing a cartridge about to be inserted into one of the resilient bands.
Figure 3:
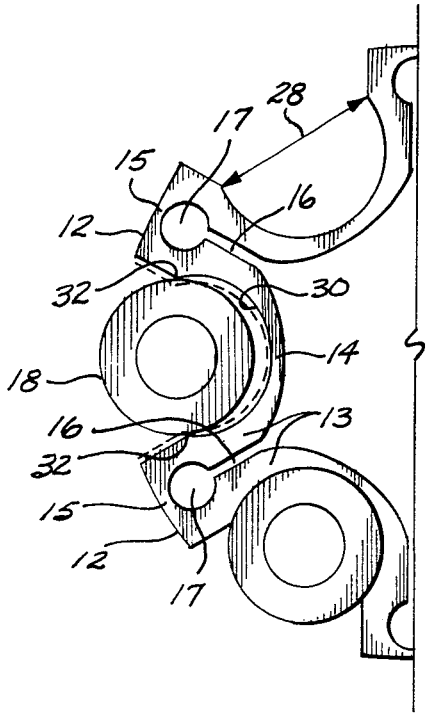
FIG. 3 is a partial plan view of a cartridge holder showing the movement of a resilient band as a cartridge is placed into position.

Referring now to FIGS. 1, 2 and 3. Each resilient band 14 has an outward facing, arcuately shaped concave surface 30, having outer end points 32. The outward facing surface of band 14 continues from point 32 in a straight line orthogonally intersecting the end point of circumferential bar 15. The straight line distance 28 between any two end points 32 of a given contact surface 30 is slightly less than the diameter of a cartridge at its end portion where the holder is applied. The area defined by the arcuate bands is preferably circular having a diameter substantially equal to or slightly less than the diameter of a cartridge.

The above-described configuration for the contact surface of the resilient band provides a means for securing the cartridge in place. Specifically, when cartridge 18 is pushed through the opening between points 32, the resilient band 14 opens to receive the cartridge 18 and, once the diameter of the cartridge is past opening 28, the contact surface 30 of the resilient band encompasses and conforms to a substantial portion of the diameter of the cartridge 18. As shown in FIG. 3, the resilient nature of the entire band 14 is utilized to provide a secure fit or "wrap" around the cartridge 18. The procedure just described for inserting a cartridge is repeated until the holder is fully loaded. Because of the wrapping action of the resilient bands, the cartridges 18 are firmly held in the holder. There is no wobble or "play" between the cartridge 18 and the holder 10. Thus, cartridges in the holder retain a substantially parallel position, properly aligned for rapid insertion into any standard revolver cylinder.

Figure 4:
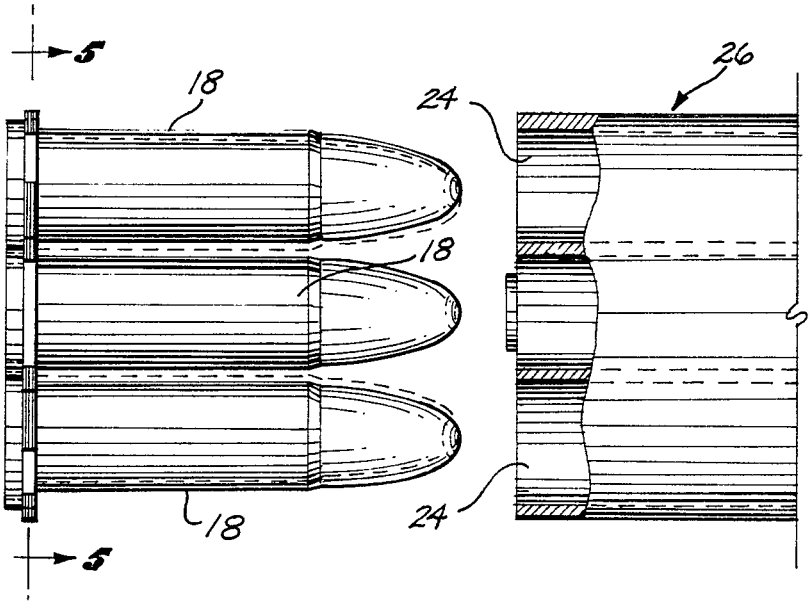
FIG. 4 is a side view of the cartridge holder fully loaded and about to be introduced into a revolver cylinder.

Referring now to FIG. 4, a standard firearm cylinder 26 includes a series of chambers 24. The center of each chamber 24 is substantially equidistant from the center of the cylinder itself, thereby forming a ring of adjacent chambers. When a loaded cartridge holder is placed into the revolver cylinder, the axial centerlines of each cartridge must align with a respective centerline of a chamber 24, as the cartridges 18 are inserted into the cylinder 26. When the cylinder is locked into the firearm, the firearm is ready for use. Because of impreciseness in the manufacturing process, as noted earlier, otherwise identical cylinders for different firearms of the same brand and model incorporate slight variations in their dimensions. For example, the distance of the centerlines of the chambers from the cylinder centerline may vary from cylinder to cylinder. It is necessary therefore that the cartridge holder can respond to these differences in dimension.

Figure 5:
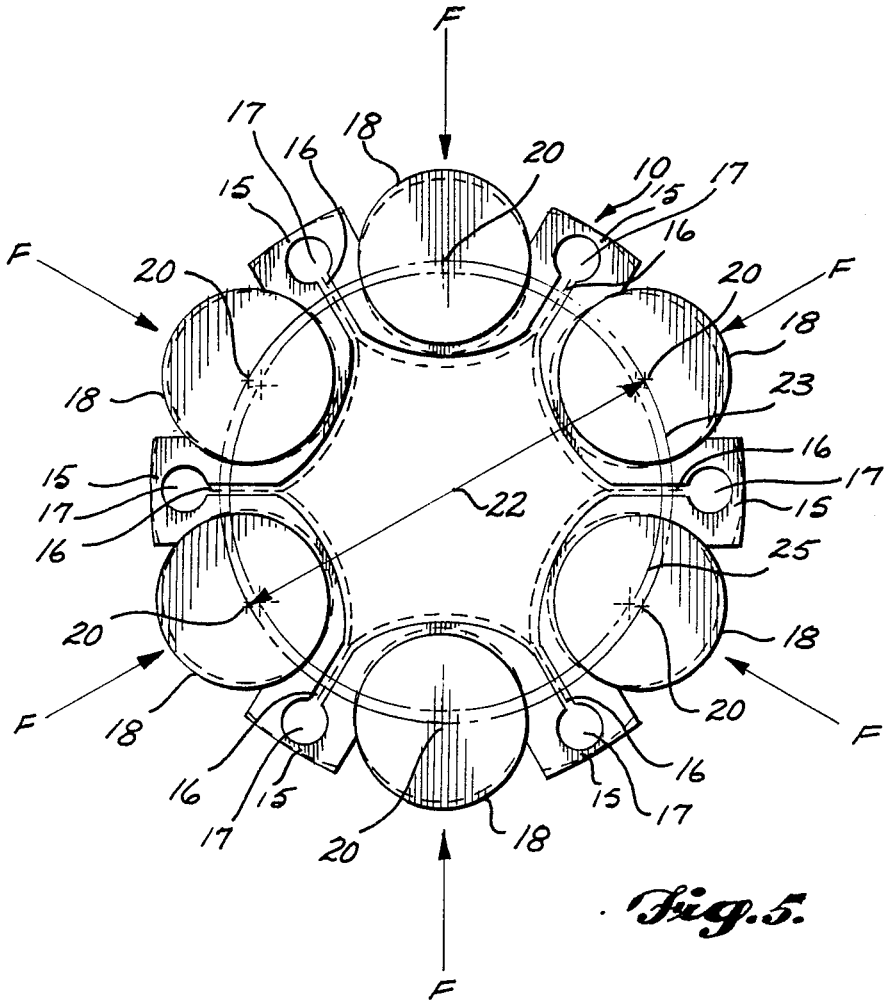
FIG. 5 is an end section of the cartridge holder showing variations in its shape after force is applied to the cartridge such as would result when the cartridge holder is placed into a revolver cylinder having a slightly smaller diameter than the normal diameter of the cartridge holder.

Referring now to FIGS. 4 and 5, when the cartridge holder 10 is in a relaxed state, as shown in solid lines, it can securely hold six cartridges. The center points 20 for each cartridge can be joined by an imaginary circle depicted by phantom line 23 of diameter 22. The ultimate shape of this circle after the loaded cartridge holder is placed into the firearm cylinder 26, is controlled by the chamber and cylinder dimensions for any particular revolver. As an example, FIG. 5 shows forces, F, which would act on the external portions of the cartridges 18 if the cartridges and holder were placed into a cylinder having a slightly smaller overall dimension; that is, the diameter of circle 23 was larger than the diameter of an imaginary circle 25 formed by connecting the center points of the chambers of the cylinder. As can be seen in the dotted lines of FIG. 5, the cartridge holder 10 will respond to these forces in a manner that the gap 16 that exists between the end portions of the resilient bands will be narrowed or closed. The overall effect of this is to decrease the diameter of the circle 23 until it matches that of the cylinder, thereby allowing complete insertion of the cartridge and holder. This change in diameter is illustrated by the two positions shown in the dotted and solid lines of FIG. 5. It can be appreciated that if the circle formed by any given cylinder chambers is shaped other than a true circle, then when the cartridges are placed into the cylinder the resulting forces will cause variations in the gap widths 16 such that some gaps will widen and some will narrow in order to accommodate the distorted circular shape of the cylinder.

It will be understood that various changes in the details, materials and configuration of the holder which has been herein described and illustrated in order to explain the nature of the invention may be made by those skilled in the art within the principle and scope of the invention as expressed in the appended claims.

The embodiments of the invention in which an exclusive property or privilege is claimed are defined as follows:

1. A cartridge holder which comprises a substantially annular flat member having a plurality of separate radially extending outward extensions, said extensions formed from the end portions of substantially arcuately shaped resilient bands, the outer ends of adjacent bands being joined by flexible bars, said bands opening outwardly so that when the end portion of a standard cartridge is pressed between any two extensions, the resilient band encompasses and conforms to a substantial portion of the circumference of said cartridge, securing said cartridge to said flat member, adjacent extensions being flexible in a circumferential direction when cartridges are positioned therein, so that said cartridges can move relative to each other upon insertion into a cylinder.

2. The cartridge holder of claim 1, wherein the said extensions are formed by one end portion from each adjacent resilient band, said end portions maintained at substantially parallel juxtaposition and joined by said bar so that a gap exists between each adjacent resilient band, the size and shape of said gap varying with the amount of force applied to any cartridge when said cartridge is placed into the chambers of a firearm cylinder.

3. A cartridge holder of substantially annular flat form which comprises at least six radially extending members emanating from a central void joined together at their innermost portions by outwardly concave arcuately shaped bands, said extending members having a first half and a second half, said first half being the mirror image of said second half, each said half beginning at the end points of two adjacent bands and projecting outwardly in substantially parallel juxtaposition forming a substantially linear radially extending gap between said first and second half, said first and second halves diverging from their parallel juxtaposition near the outer end of said radially extending members and then connecting to each other at the outermost portion of said member such that the gap between said first and second halves becomes enlarged and then terminates inside the connecting portion of said first and second halves, said arcuately shaped bands and said radially extending members combining to form receptacles for securing cartridges to said holder.

4. The cartridge holder of claim 3, wherein all of the elements are formed of spring steel.

5. The cartridge holder of claim 4, wherein the enlarged portion of said gap is substantially circular.

* * * * *